US008197080B2

(12) United States Patent
Fujihara et al.

(10) Patent No.: US 8,197,080 B2
(45) Date of Patent: Jun. 12, 2012

(54) ILLUMINATION DEVICE FOR MULTINEEDLE SEWING MACHINE AND THE MULTINEEDLE SEWING MACHINE

(75) Inventors: Shinya Fujihara, Ichinomiya (JP); Nobuaki Matsumoto, Nagoya (JP); Junnosuke Matsuda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 366 days.

(21) Appl. No.: 12/656,414

(22) Filed: Jan. 28, 2010

(65) Prior Publication Data

US 2010/0208450 A1 Aug. 19, 2010

(30) Foreign Application Priority Data

Feb. 19, 2009 (JP) ..... 2009-036492

(51) Int. Cl.
*D05B 79/00* (2006.01)

(52) U.S. Cl. ..... 362/90; 362/89; 362/127; 362/132; 362/133; 362/134; 362/418

(58) Field of Classification Search ..... 362/89, 362/90, 127, 132–134, 249.01–249.03, 249.1, 362/418
See application file for complete search history.

(56) References Cited

FOREIGN PATENT DOCUMENTS

| | | |
|---|---|---|
| JP | A-11-253685 | 9/1999 |
| JP | B2-3258929 | 2/2002 |
| JP | A-2007-229291 | 9/2007 |

*Primary Examiner* — William Carter
(74) *Attorney, Agent, or Firm* — Oliff & Berridge, PLC

(57) ABSTRACT

An illumination device for a multineedle sewing machine is disclosed. The sewing machine includes a plurality of needle bars having lower ends to which needles are attached respectively and a needle bar case supporting the needle bars so that the needle bars are movable upward and downward. The illumination device includes an illuminating member having a light source, and a support unit located in the needle bar case for supporting the illuminating member so that the illuminating member is switchable between an illuminating position where the illuminating member is located in front of the needle bars or the needles to illuminate a periphery of a needle point of the needle location point of the needle by the light source and a storage position where the illuminating member opens a front side of the needle bar or the needle and is located laterally with respect to the needle bar case.

7 Claims, 12 Drawing Sheets

ILLUMINATION DEVICE FOR MULTINEEDLE SEWING MACHINE AND THE MULTINEEDLE SEWING MACHINE

CROSS-REFERENCE TO RELATED APPLICATIONS

This application is based on and claims the benefit of priority from the prior Japanese Patent Application No. 2009-36492, filed on Feb. 19, 2009, the entire contents of which are incorporated herein by reference.

BACKGROUND

1. Field

The present disclosure relates to an illumination device for a multineedle sewing machine provided with a plurality of needle bars having lower ends to which needles are attached, respectively and a needle bar case which supports the needle bars so that the needle bars are movable upward and downward, and the multineedle sewing machine provided with the illumination device.

2. Related Art

There have conventionally been provided multineedle sewing machines of the above-described type which include an illumination device for illuminating a needle base of each needle or a surface of workpiece cloth. More specifically, a fluorescent lamp serving as an illumination device is mounted on an underside of a needle bar case so as to hang forward along juxtaposition of the needle bars, whereupon the needle base of each needle bar is adapted to be sufficiently illuminated by the fluorescent lamp.

On the other hand, in general sewing machines other than the multineedle sewing machine, a holder for an illuminating member has been proposed which is operable to hold an illuminator side member serving as an illuminating member on a sewing machine side member. The holder includes a pipe bracket provided on an upper surface of an arm of the sewing machine and a support pipe which supports the illuminating member on a distal end of the bracket with a hinge being interposed therebetween so that the illuminating member is pivotable. In the proposed holder, hinges are also mounted on ends and middle portions of the support pipe other than the aforesaid hinge, so that the support pipe or the illuminating member is caused to pivot with the hinge portions serving as a fulcrum. As a result, the position of the illuminating member can be adjusted, whereupon a desired portion such as the periphery of needlepoint of each needle can be illuminated.

However, the fluorescent lamp sometimes becomes an obstacle in the threading of a needle thread or in replacement of needles in the above-described former multineedle sewing machine since the fluorescent lamp is located in front of the needle bars and the needle thread.

In the above-described holder for the illuminating member, the illuminating member can be moved to a location where the illuminating member does not become an obstacle in a maintenance work or the like. In this case, however, the illuminating member is moved from an optimum location that has been set by the user to another location. Accordingly, the illuminating member needs to be readjusted or reset to the former location after completion of the maintenance work or the like. The readjustment is troublesome.

More specifically, when an illuminating member is fixedly mounted in the multineedle sewing machine or when an illuminating member is provided so that the location thereof is adjustable by application of the aforesaid holder, both cases involve respective disadvantages. Accordingly, it has been desired to overcome both disadvantages at simultaneously.

SUMMARY

Therefore, an object of the present disclosure is to provide an illumination device for a multineedle sewing machine, which has an improved usability and can hold an illuminating member at such a position that the illuminating member does not become an obstacle, and a sewing machine provided with the illumination device.

The present disclosure provides an illumination device for a multineedle sewing machine which includes a plurality of needle bars having lower ends to which needles are attached respectively and a needle bar case supporting the needle bars so that the needle bars are movable upward and downward, the illumination device comprising an illuminating member having a light source; and a support unit provided in the needle bar case for supporting the illuminating member so that the illuminating member is switchable between an illuminating position where the illuminating member is located in front of the needle bars or the needles to illuminate a periphery of a needle point of the needle location point of the needle by the light source and a storage position where the illuminating member opens a front side of the needle bar or the needle and is located laterally with respect to the needle bar case.

According to the above-described construction, the periphery of the needle location point of the needle can sufficiently be illuminated when the illuminating member is located at a position in front of the needle bar or the needle, which position serves as the illuminating position. On the other hand, when the illuminating member is located laterally with respect to the needle bar case, which position serves as the storage position, a needle thread can be threaded and a needle can be changed to another needle while an area in front of the needle bars and the needle is completely open. Accordingly, the illuminating member does not become an obstacle. Furthermore, since the illuminating member is easily switched between the illuminating position and the storage position by the support unit, the usability of the illumination device can be improved.

DETAILED DESCRIPTION

One embodiment will be described with reference to the accompanying drawings. An illumination device is applied to a multineedle sewing machine M in the embodiment. In the following description, the user is located in front of the multineedle sewing machine M.

Figure 1:
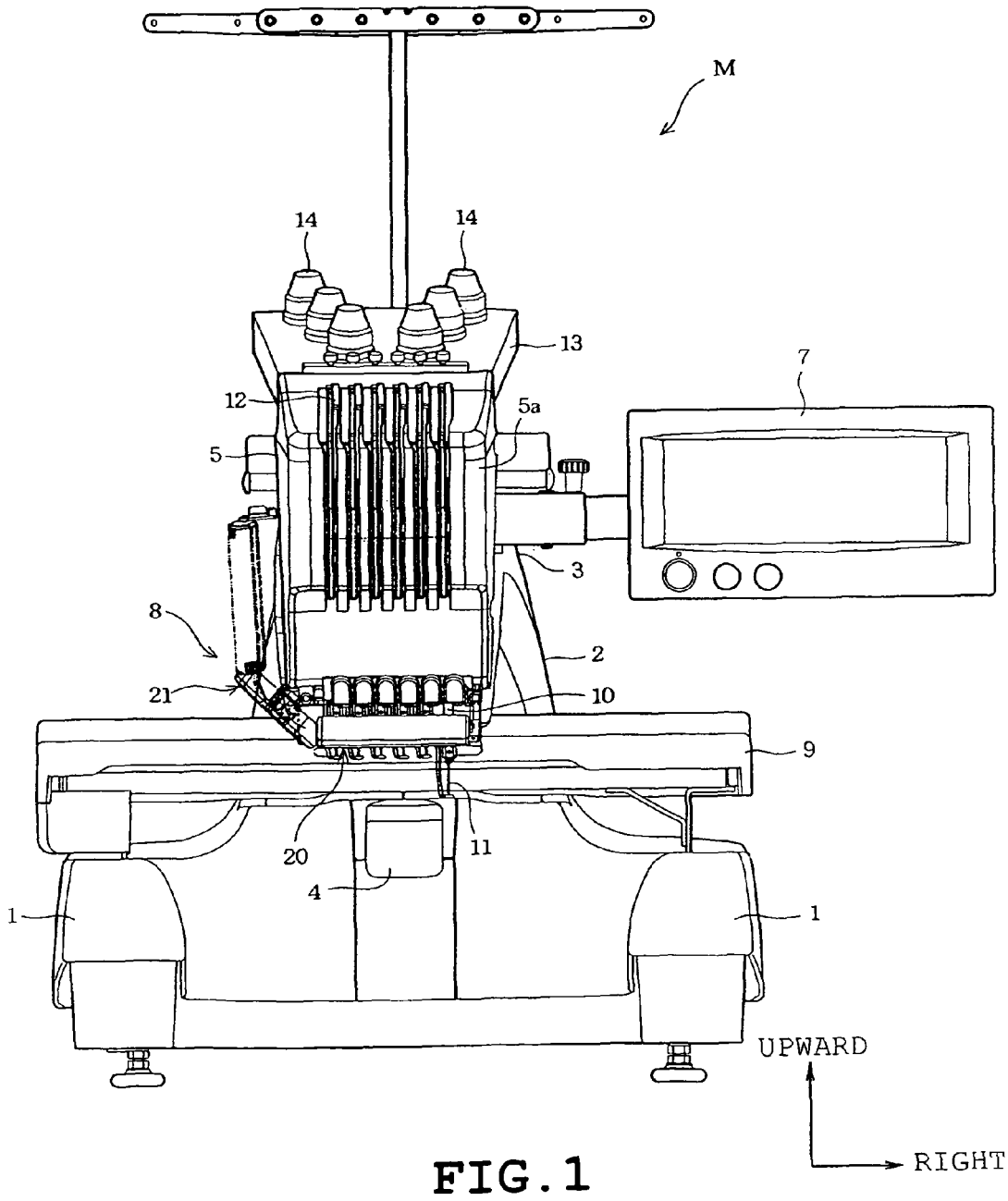
FIG. 1 is a front view of a multineedle sewing machine provided with an illumination device in accordance with one embodiment.
Figure 12:
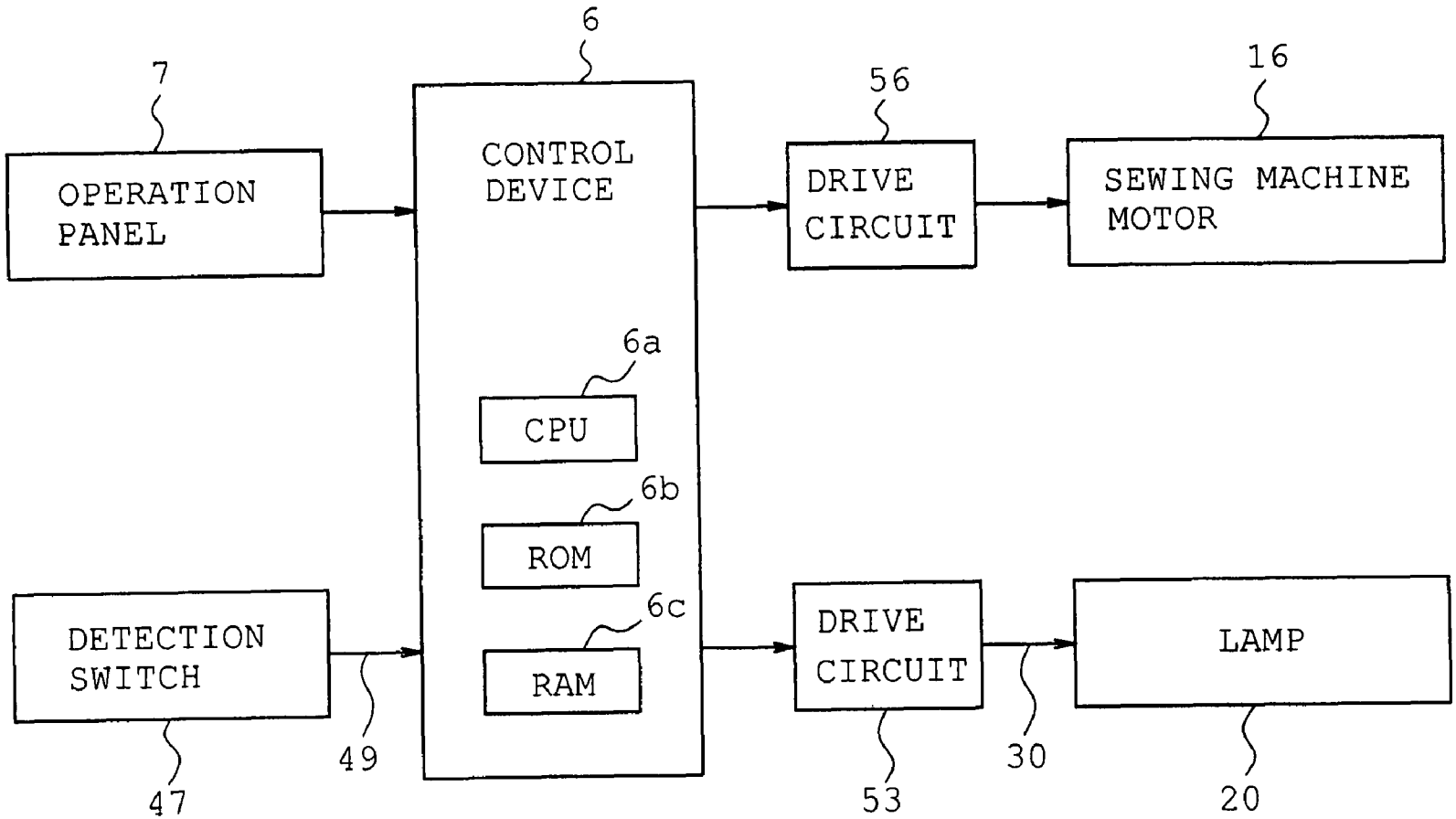
FIG. 12 is a block diagram showing an electrical arrangement of the illumination device.

Referring to FIG. 1, the multineedle sewing machine M includes a pair of right and left legs 1 supporting an overall sewing machine M, a support column 2 standing on rear ends of the legs 1, an arm 3 extending ahead of an upper part of the support column 2, a cylinder bed 4 extending ahead of a lower end of the support column 2, a needle bar case 5 attached to a front end of the arm 3, a control device 6 (see FIG. 12) controlling an overall multineedle sewing machine M and an operation panel 7.

Japanese patent application publication, JP-A-2007-229291 which application was filed by the assignee of the present application, discloses the same construction as the multineedle sewing machine M except for an illumination device 8. Accordingly, the construction of the multineedle sewing machine M will briefly be described in the following. The multineedle sewing machine M includes a carriage 9 which is disposed on upper parts of the legs 1 so that the carriage 9 is directed in a right-left direction. The carriage 9 is driven by a Y-direction drive mechanism (not shown) in the Y direction so that a frame mounting (not shown) provided on a front part of the carriage 9 is driven in the X direction by an X-direction drive mechanism (not shown). A workpiece cloth to be embroidered is held by a rectangular embroidery frame (not shown). The embroidery frame is mounted on the frame mounting so as to be moved in the Y direction in synchronization with the carriage 9 or in the X direction with the frame mounting, whereby the workpiece cloth is fed.

Figure 3:
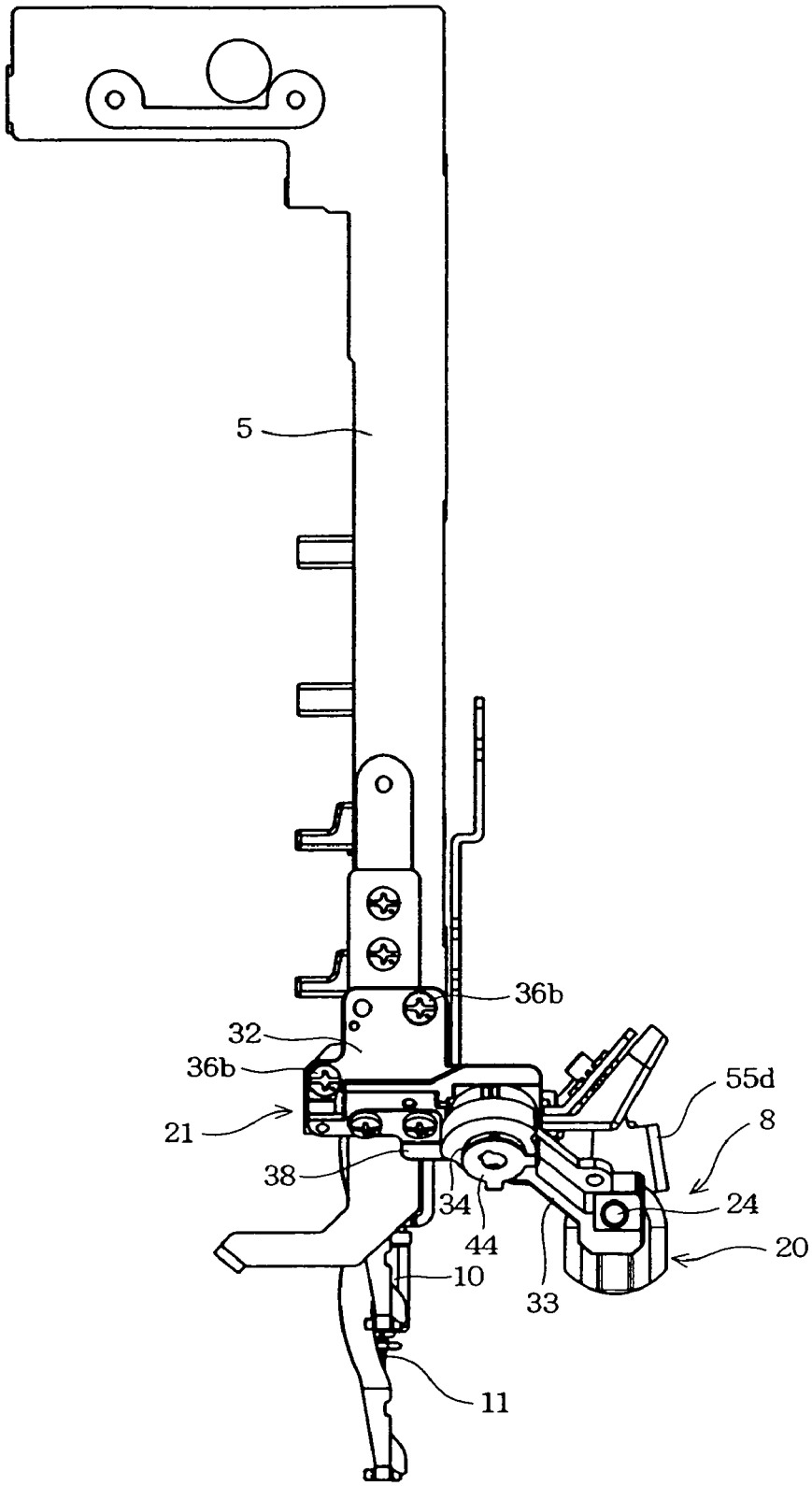
FIG. 3 is a view similar to FIG. 2A, showing the state where covers of the needle bar case and support device are removed.

Six needle bars 10 which are arranged in the right-left direction so as to extend in the vertical direction are supported on the needle bar case 5 so as to be movable upward and downward. The needle bars 10 have lower ends to which needles 11 are attached, respectively. Six thread take-up levers 12 corresponding to the respective needle bars 10 are also attached to the needle bar case 5. A cover 5*a* made from a synthetic resin is mounted on the needle bar case 5. FIG. 3 shows the needle bar case 5 with the cover 5*a* being removed.

The needle bar case 5 has an upper end to which an inclined thread tension bracket 13 is fixed. Six thread tensioners 14 for upper threads supplied to the respective needles 11 are provided on the thread tension bracket 13. A spool holder base is provided on an upper part of the arm 3 although not shown. Six spool holder pins (not shown) stand on the spool holder base. Needle threads drawn from thread spools attached to the spool holder pins are passed through the thread tensioners 14, the thread take-up levers 12 and the like, thereafter being fed to eyes (not shown) of the needles 11, respectively. A needle bar selecting mechanism (not shown) is provided in the arm 3 to move the needle bar case 5 in the X direction in thread exchange. One of the six sets of needle bars 10 and thread take-up levers 12 is selectively moved to a driving position. The needle bar 10 and the thread take-up lever 12 are synchronously moved upward and downward at the driving position by a sewing machine motor 16 (see FIG. 12) and are co-operated with a rotary hook (not shown) provided on a front end of the cylinder bed 4 so that embroidery stitches are formed on a workpiece cloth held by the embroidery frame.

Figure 7A:
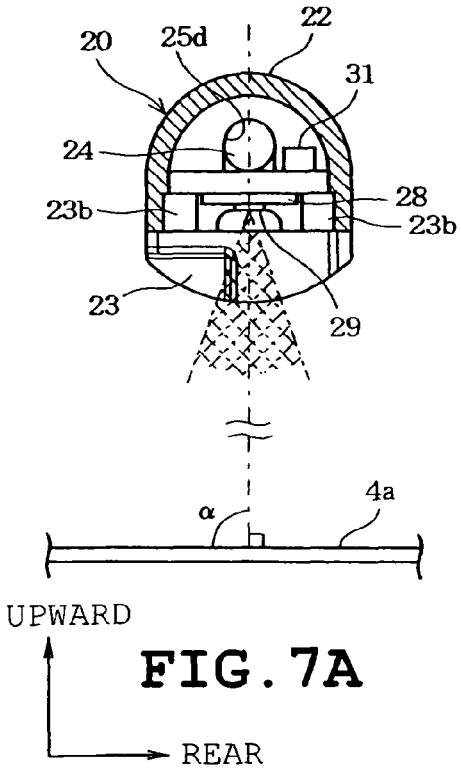
FIGS. 7A and 7B are partially broken right side views of the illuminating apparatus illuminating a lower area and a diagonally lower backward area respectively.
Figure 7B:
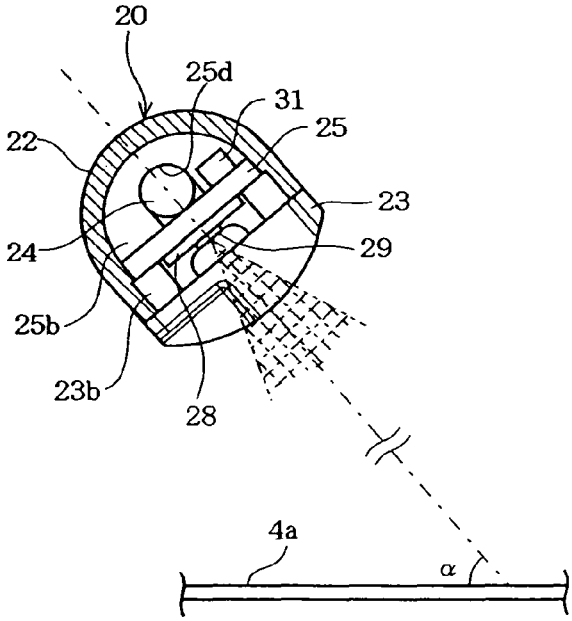

A needle plate 4*a* (as shown in FIGS. 7A and 7B) is provided on an upper surface of the cylinder bed 4. The needle plate 4*a* is formed with a needle hole (not shown) serving as a needle position of the needle 11. An illumination device 8 is provided on the needle bar case 5 to illuminate the periphery of the needle point.

Figure 4:
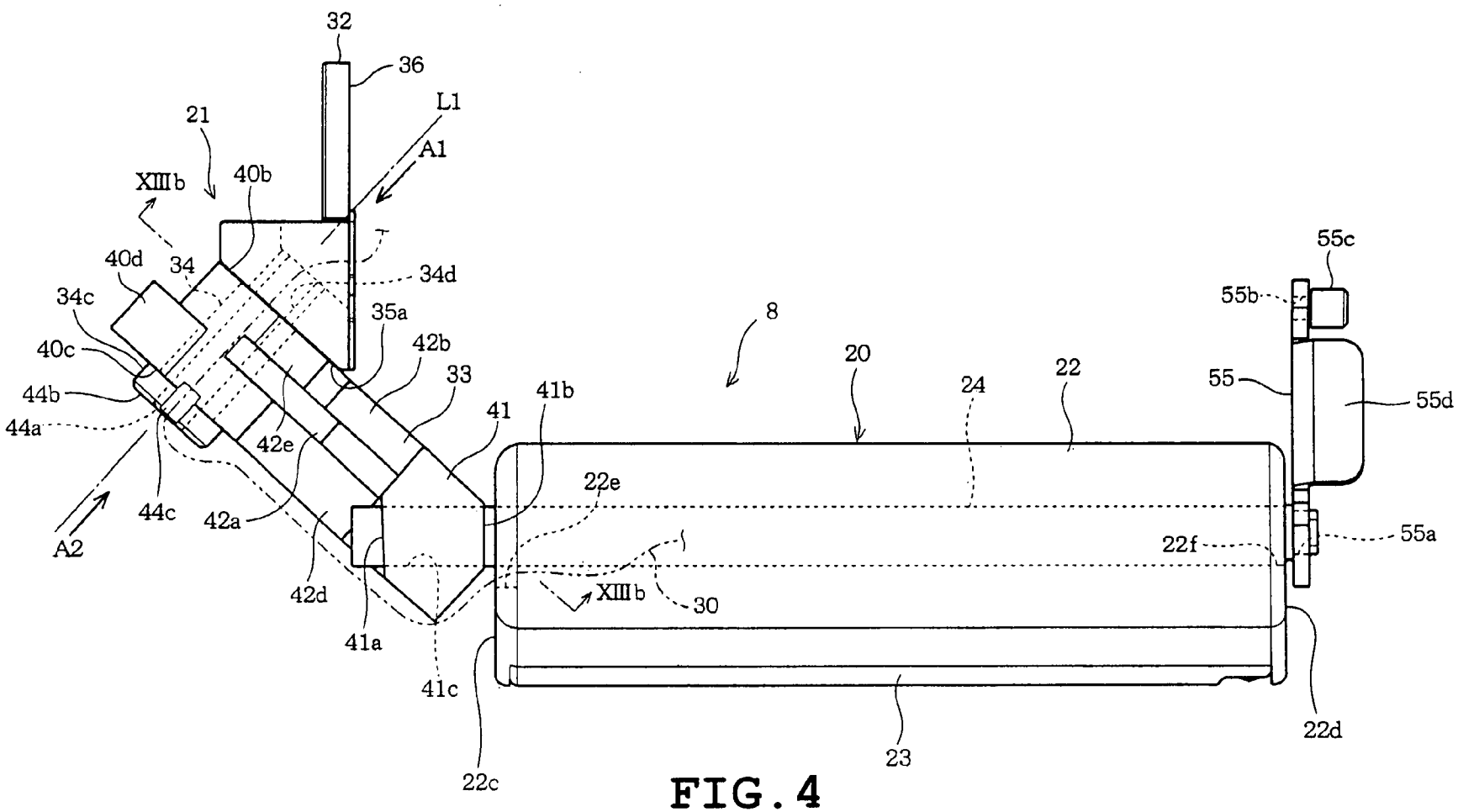
FIG. 4 is a front view of the illumination device assuming the illuminating position.
Figure 5A:
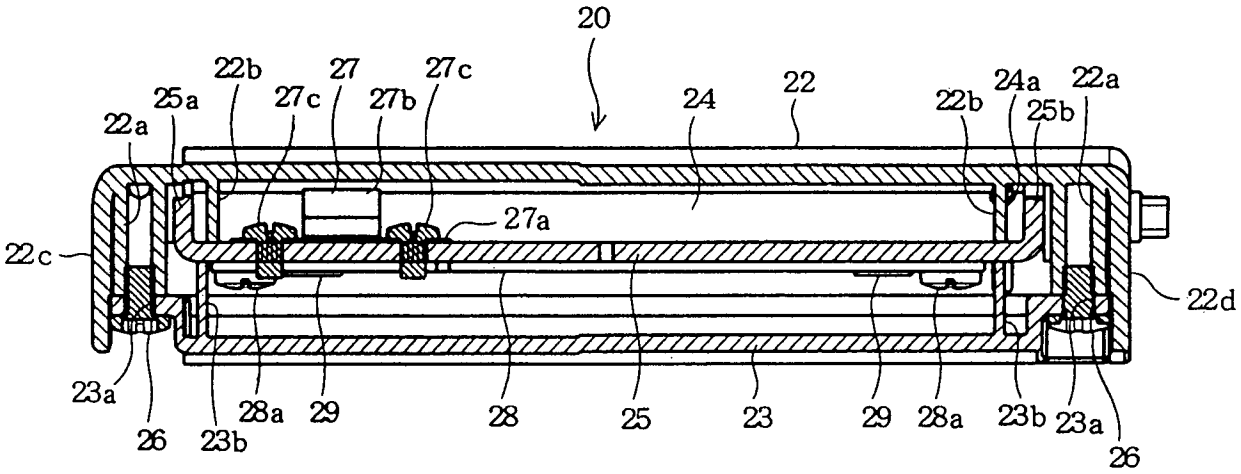
FIGS. 5A and 5B are a sectional view taken along line Va-Va in FIG. 8 and a bottom view of the illuminating apparatus as viewed from the light transmission side, respectively.

The illumination device 8 will now be described with reference to FIGS. 2A to 8B. The illumination device 8 includes an elongate lamp 20 serving as an illuminating member and having a light source and a support unit 21 provided in the needle bar case 5 to support the lamp 20. The lamp 20 includes a cover body 22 serving as an external body and a light transmitting portion 23 provided on the underside of the cover body 22. The lamp 20 is generally formed into an elongate shape. The cover body 22 is made of a synthetic resin, for example, and is generally formed into a semicylindrical shape with a hollow interior and an open underside. A pair of bosses 22*a* are formed in the cover body 22 so as to be located at right and left ends respectively as shown in FIG. 5A. A pair of upper ribs 22*b* are formed with the bosses 22*a* so as to be located right inside the bosses 22*a* and to extend downward respectively. The cover body 22 has right and left end faces 22*d* and 22*c* formed with through holes 22*f* and 22*e* (see FIG. 4) through which rod members 24 which will be described later extend. The through hole 22*e* located at the proximal end side of the lamp 20 is formed so as to be cut off into a slightly larger size than the through hole 22*f*, whereupon a lead wire 30 of the lamp 20 is drawn therethrough.

Figure 5B:
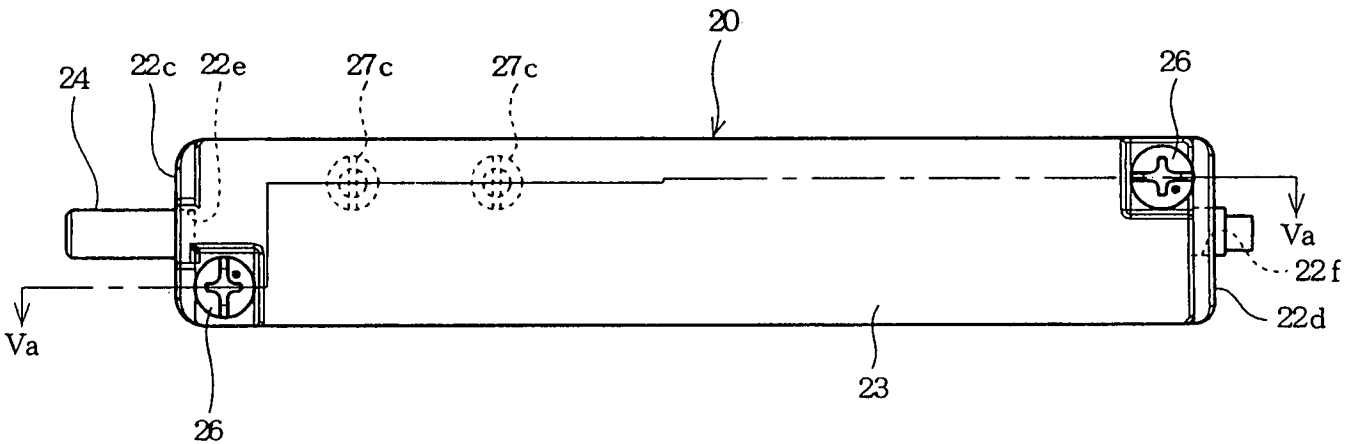

The light transmitting portion 23 is made of a transparent acrylic material and formed into the shape of a shallow rectangular container covering the cover body 22 from below as shown in FIGS. 5A, 5B and 7A. The light transmitting portion 23 has an underside formed into a gentle arc shape as viewed in a side view and an upper surface formed with a pair of screw holes 23*a* (see FIG. 5A) corresponding to the bosses 22*a* respectively. Screws 26 inserted through the screw holes 23*a* are further threadingly engaged with the bosses 22*a* of the cover body 22 respectively, whereby the light transmitting portion 23 is fixed to the cover body 22. Furthermore, lower ribs 23*b* corresponding to the respective upper ribs 22*b* are formed on the upper side of the light transmitting portion 23. A base member 25 made of a metal plate is housed in the lamp 20 and held between the upper and lower ribs 22*b* and 23*b*.

Figure 8A:
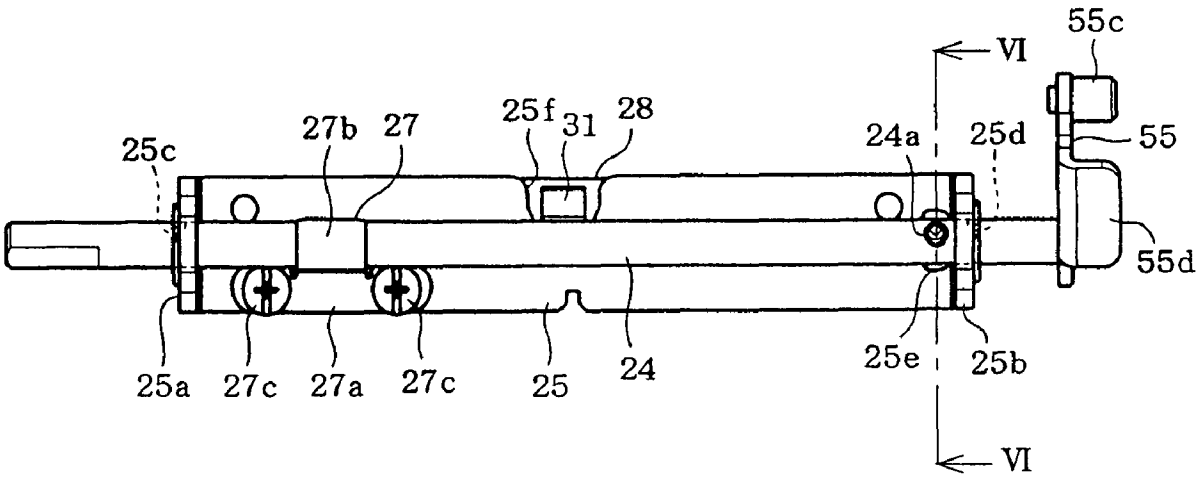
FIGS. 8A and 8B are a plan view and a side view of the illuminating apparatus, showing the inner structure of the illuminating apparatus.
Figure 8B:
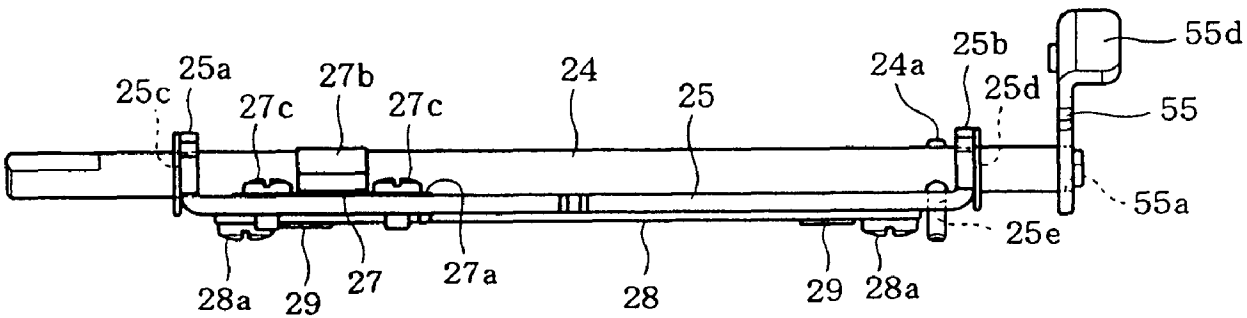

A pair of upwardly bent portions 25*a* and 25*b* are provided on both ends of the base member 25 respectively as shown in FIGS. 8A and 8B. The bent portions 25*a* and 25*b* are formed with respective through holes 25*c* and 25*d* through which the rod member 24 extends. When the rod member 24 is inserted through the through holes 2*e* and 22*f* and the through holes 25*c* and 25*d* of the base member 25, the lamp 20 mounted on the rod member 24 so as to be rotatable.

Figure 6:
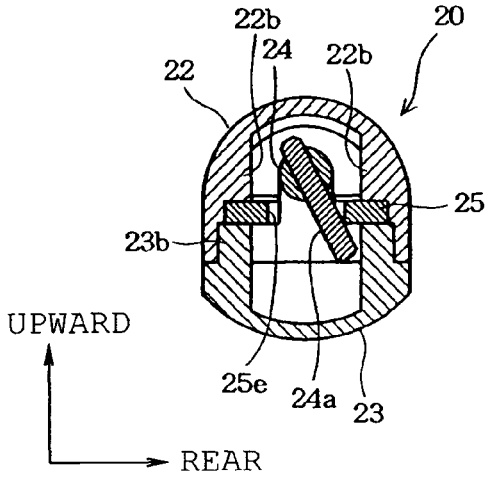
FIG. 6 is a sectional view taken along line VI-VI in FIG. 8A.

An end of the base member 25 located at the bent portion 25*b* side is formed with an oval hole 25*e* (see FIGS. 6 and 8A) extending in a direction perpendicular to a long side of the rod member 24. On the other hand, a lock pin 24*a* protruding radially outward with respect to the rod member 24 is secured to the rod member 24. The lock pin 24*a* is inserted through the hole 25*e* and abuts an inner wall of the hole 25*e* when the base member 25 is rotatively moved relative to the rod member 24, thereby limiting a range of rotative movement of the base member 25. More specifically, the range of rotative movement of the lamp 20 is limited to a predetermined range suitable for lighting of the periphery of the needle position. For example, when the lock pin 24*a* abuts a rear part of the inner wall of the hole 25*e* as shown in FIG. 6, an illumination angle α in the front-back direction with respect to the periphery of the needle position is limited to about 90 degrees so that the lamp 20 is prevented from being directed to the user (frontward) as shown in FIG. 7A. Furthermore, the lock pin 24*a* abuts a front part of the inner wall of the hole 25*e* when the lamp 20 is rotatively moved as shown in FIG. 7. In this case, the illumination angle α is limited so as not to be rendered excessively small (not to be excessively inclined rearward). FIG. 6 is a section taken along line VI-VI in FIG. 8A. Although FIG. 8A does not show the cover body 22 and the light transmitting portion 23, the section as shown in FIG. 6 includes the cover body 22 and the light transmitting portion 23 for the sake of easiness in the explanation of FIGS. 7A and 7B.

A first leaf spring 27 maintaining the lamp 20 at the position in the direction of rotative movement is disposed on an end of the base member 25 located at the bent portion 25*a* side as shown in FIGS. 8A and 8B. The first leaf spring 27 includes a plate-shaped fixing portion 27*a* and a semicylindrical spring piece 27*b* formed on a side of the fixing portion 27*a*, both of which are formed integrally with the spring 27. The first leaf spring 27 is mounted at its fixing portion 27*a* on the base member 25 by two screws 27*c*. The first leaf spring 27 is constructed as a holding unit which holds the base member 25 (the lamp 20) at any position with the aforementioned range of rotative movement when the spring piece 27*b* is elastically pressed against a circumferential surface of the rod member 24. A notch 25*f* is formed in the lengthwise middle of the base member 25, and a substrate 28 is disposed on the underside of the base member 25.

The substrate 28 is formed into a plate shape and extends along the base member 25 and is fixed at its two ends to the base member 25 by a pair of screws 28. A plurality of (two, for example) chip LEDs 29 serving as a light source are disposed on the underside of the substrate 28. The chip LEDs 29 are attached to the substrate 28 so as to be spaced from each other along the plural needle bars 10 at an illuminating position of the lamp 20. A connector 31 to which a lead wire 30 for energizing the chip LEDs 29 is connected is provided on the upper surface of the substrate 28 at a position where the connector faces the notch 25*f* of the base member 25.

The lamp 20 is supported by a supporting device 21 so as to be switchable between the illuminating position (shown by solid line in FIGS. 2A and 2B) where the periphery of the needle position is illuminated and a storage position (shown by two-dot chain line in FIGS. 2A and 2B) where the lamp 20 is located along the side of the needle bar case 5.

The supporting device 21 will now be described in detail with reference to FIGS. 9 to 11B as well as FIGS. 1 to 8B. As shown in FIG. 4, the supporting device 21 includes a mounting portion 32 fixed to the side of the needle bar case 5, a connecting arm 33 connecting the mounting portion 32 and the lamp 20, and a support shaft 34 which is mounted on the mounting portion 32 and further to the connecting arm 33 on which the lamp 20 is mounted, whereby the lamp 20 is supported by the support shaft 34 so as to be swingable.

Figure 9:
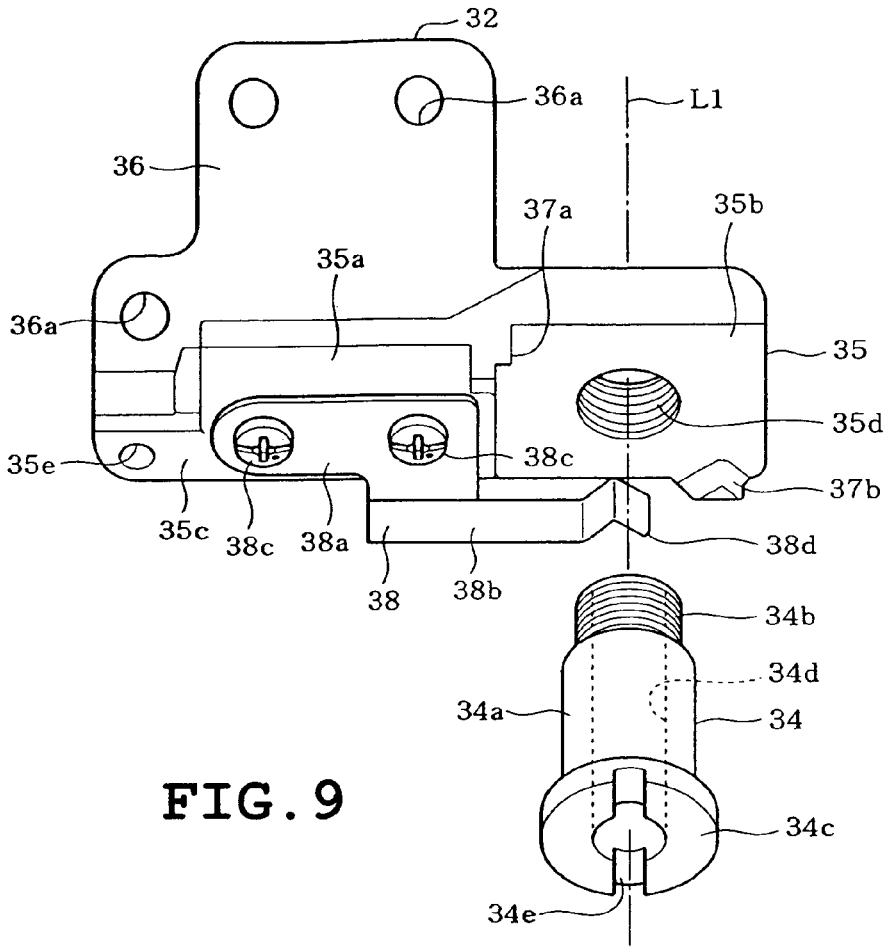
FIG. 9 is an enlarged exploded side view of a mounting portion and a support shaft.

The mounting portion 32 includes an inclined portion 35 which extends in the front-back direction and has an inclined surface 35*a*, and a flat plate portion 36 protruding upward from a latter half of the inclined portion 35, as shown in FIG. 9. The inclined portion 35 and the flat plate portion 36 are formed integrally with the mounting portion 32. The mounting portion 32 is formed substantially into the L-shape as viewed in a side view. The flat plate portion 36 is formed with a pair of mounting holes 36*a*, and the mounting portion 32 is mounted on a left-side lower end of the needle bar case 5 by the screws 36*b* (see FIG. 3) inserted through the respective mounting holes 36*a*. The inclined surface 35*a* of the mounting portion 32 includes a front inclined surface 35*b* constituting a front half thereof and a rear inclined surface 35*c* constituting a rear half thereof. Both inclined surfaces 35*b* and 35*c* are inclined at 45 degrees to the flat plate portion 36, for example (see FIG. 4). The front inclined surface 35*b* has a screw hole 35*d* formed through the central part thereof. The support shaft 34 is adapted to extend vertically through screw hole 35*d*. Furthermore, two convex lock pieces 37*a* and 37*b* are formed on a rear upper end and a front lower end of the front inclined surface 35*b* (that is, on two opposite corners) respectively. A second leaf spring 38 formed into a crank shape is disposed on the rear inclined surface 35*c*. The second leaf spring 38 includes a plate-shaped fixing portion 38*a* extending along the rear inclined surface 35*c* and a band-shaped spring piece 38*b* which is formed on a lower end of the fixing portion 38*a* so as to extend forward. The second leaf spring 38 is mounted at its fixing portion 38*a* on the rear inclined surface 35*c* by two screws 38*c*. The spring piece 38*b* has a distal end formed with an angle abutting portion 38*d* which is adapted to be selectively fitted into one of the detent recesses 39*a* and 39*b* (see FIGS. 10, 13B and 14B).

The support shaft 34 has a shaft body 34*a*, a screw 34*b* formed on one of two ends of the shaft body 34*a* and a head 34*c* formed on the other end o the shaft body 34*a*, all of which are formed integrally with the support shaft 34, as shown in FIG. 9. The screw portion 34*b* is threadingly inserted into screw hole 35*d* so that the support shaft 34 is mounted on the inclined portion 35. As a result, the support shaft 34 is set so that a central axis (hereinafter, "swing central axis line L1") thereof is parallel to a central axial line L2 of the needle bar 10 (see FIG. 2B) and so that the central axis (hereinafter, a central swing axis line L1) is inclined at a predetermined angle (an inclination angle of 45 degrees, for example, see FIG. 2A). The support shaft 34 has a through hole 34*d* formed along the central swing line L1. Furthermore, the head 34*c* of the support shaft 34 is formed with a groove 34*e* to facilitate rotation of the support shaft 34 with a tool.

Figure 10:
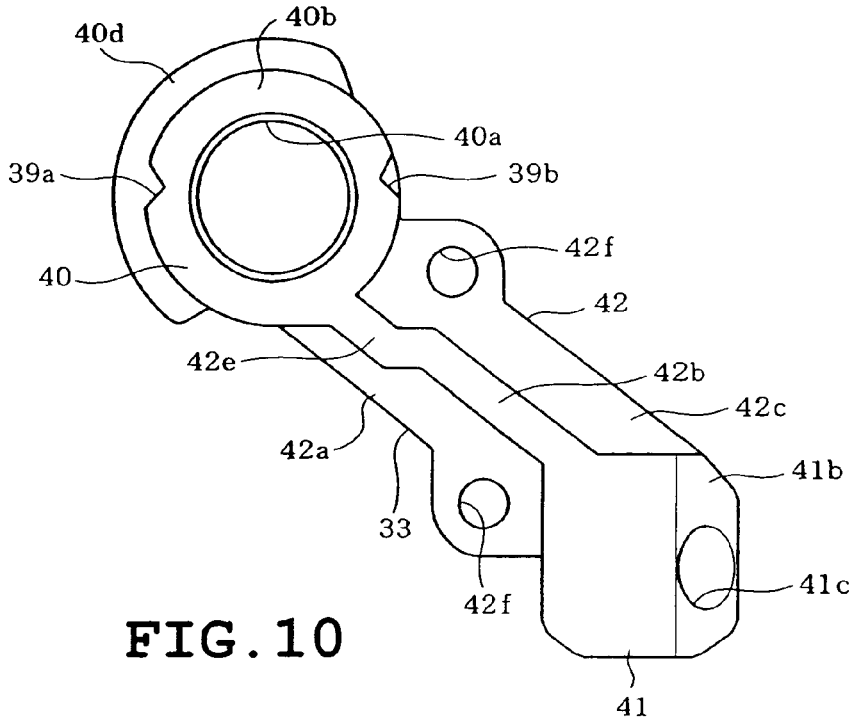
FIG. 10 is an enlarged view of a connecting arm as viewed in the direction of arrow A1 in FIG. 4.

The connecting arm 33 connects the mounting portion 32 and the lamp 20 and extends along the inclined surface 35*a* of the mounting portion 32 as shown in FIG. 4. The connecting arm 33 is mounted via the support shaft 34 on the mounting portion 32 so as to be swingable. As described in more detail, the connecting arm 33 comprises a cylindrical portion 40 located at the proximal end side, a block portion 41 located at the distal end side (the lamp 20 side) and an arm portion 42 connecting the cylindrical portion 40 and the block portion 41 as shown in FIG. 10. The support shaft 34 is inserted through the cylindrical portion 40. The cylindrical portion 40 has an inner circumferential surface 40*a* with which the shaft body 34*a* is adapted to be brought into sliding contact. Furthermore, the cylindrical portion 40 has an axial end face 40*b* which is adapted to be brought into sliding contact with the front inclined surface 35*b* of the mounting portion 32. The cylindrical portion 40 has an outer circumference formed with detent recesses 39*a* and 39*b* located at the end face 40*b* and opposed to each other at an interval of about 180 degrees and with a radially outwardly jutting sectorial cam 40*d* located at the other end face 40*c* side (see FIGS. 4 and 13A).

The block portion 41 is formed with chamfered surfaces 41*a* and 41*b* which are vertical to each other at the illuminating position of the lamp 20 as shown in FIG. 4. The block portion 41 is further formed with a hole 41*c* extending therethrough so that the hole 41 is perpendicular to the chamfered surfaces 41*a* and 41*b*. One of two ends of the rod member 24 is inserted through the hole 41*c* to be secured by a screw (not shown). As a result, the connecting arm 33 is adapted to be swung about the swing center axis line L1 together with the rod member 24 (the lamp 20).

The arm portion 42 is formed into the shape of shaped steel having a substantially cross section and has four flanges 42*a*, 42*b*, 42*c* and 42*d*, all of which are formed integrally therewith, as shown in FIGS. 4 and 10. The flange 42*b* has an end which is located near the end face 40*b* of the cylindrical portion 40 and formed with a crank-shaped engagement stepped portion 42*e*. The engagement stepped portion 42*e* abuts the lock piece 37*a* or 37*b* of the mounting portion 32 to lock the lock pieces, thereby limiting the swinging range of the lamp 20. More specifically, when the engagement stepped portion 42*e* is locked by the lock piece 37*b* in the swing of the lamp 20 (see FIG. 13B), the lamp 20 is located at the front side of the needle bar 10 or the needle 11 thereby to occupy an illuminating position where the periphery of the needle position is illuminated by the chip LEDs 29. Furthermore, when the engagement stepped portion 42*e* is locked by the lock piece 37*a* in the swing of the lamp 20 (see FIG. 14B), the lamp 20 opens the front sides of the needle bar 1 and the needle 11 and is located along the side of the needle bar case 5.

Figure 13A:
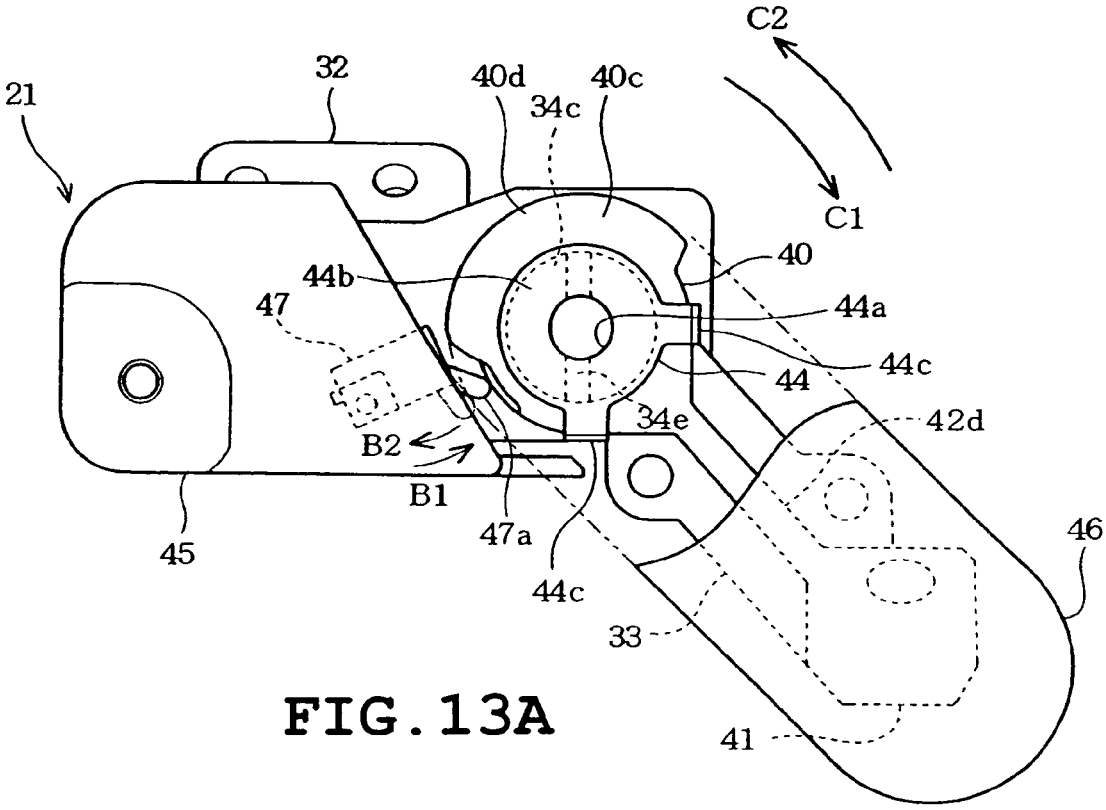
FIG. 13A is an enlarged view of a support device as viewed in the direction of arrow A2 in FIG. 2 with the illuminating apparatus having been switched to the illuminating position.
Figure 13B:
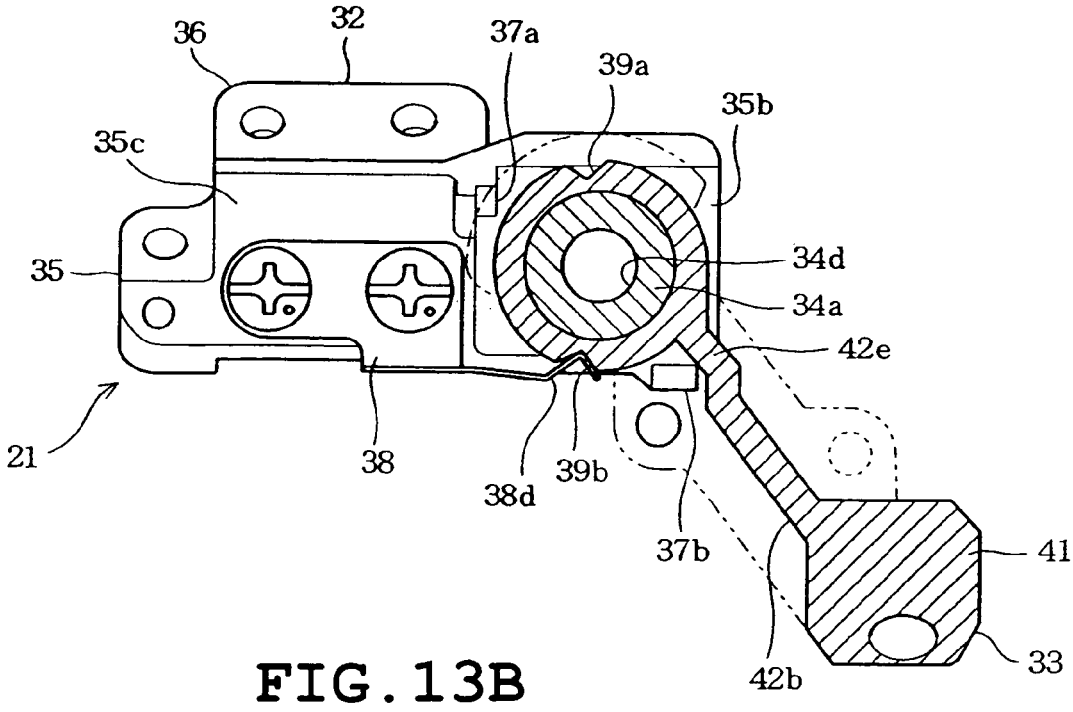
FIG. 13B is a sectional view taken along line XIIIb-XIIIb in FIG. 4.

The cylindrical portion 40 of the connecting arm 33 is provided with a washer 44 covering the head 34*c* of the support shaft 34 as shown in FIGS. 4 and 13A. The washer 44 includes an annular plate 44*b* having a hole 44*a*, and a pair of protrusions 44*c* protruding radially outward from an outer edge of the annular plate 44*b*, both of which are formed integrally therewith. The washer 44 is swung together with the connecting arm 33 when the protrusions 44*c* are bent along the cylindrical portion 40 of the connecting arm 33. The lead wire 30 is passed through the hole 44*a* of the washer 44 and the hole 34*d* of the support shaft 34. Since the head 34*c* is covered by the annular plate 44*b*, the lead wire 30 is prevented from being damaged by the contact with the groove 34*e* of the head 34*c* during swing of the connecting arm 33.

Figure 11A:
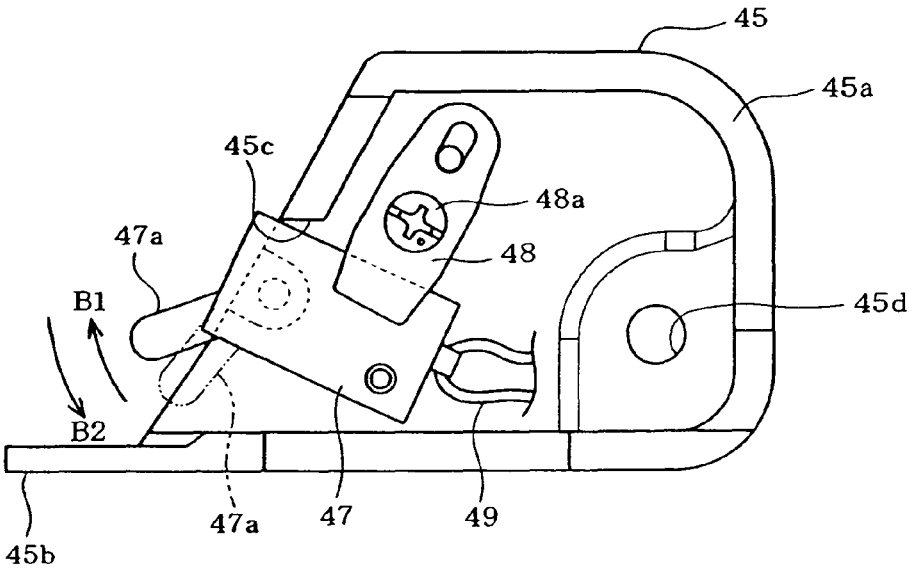
FIGS. 11A and 11B are enlarged views of covers of a mounting cover and an arm as viewed in the direction of arrow A1 in FIG. 2 respectively.
Figure 11B:
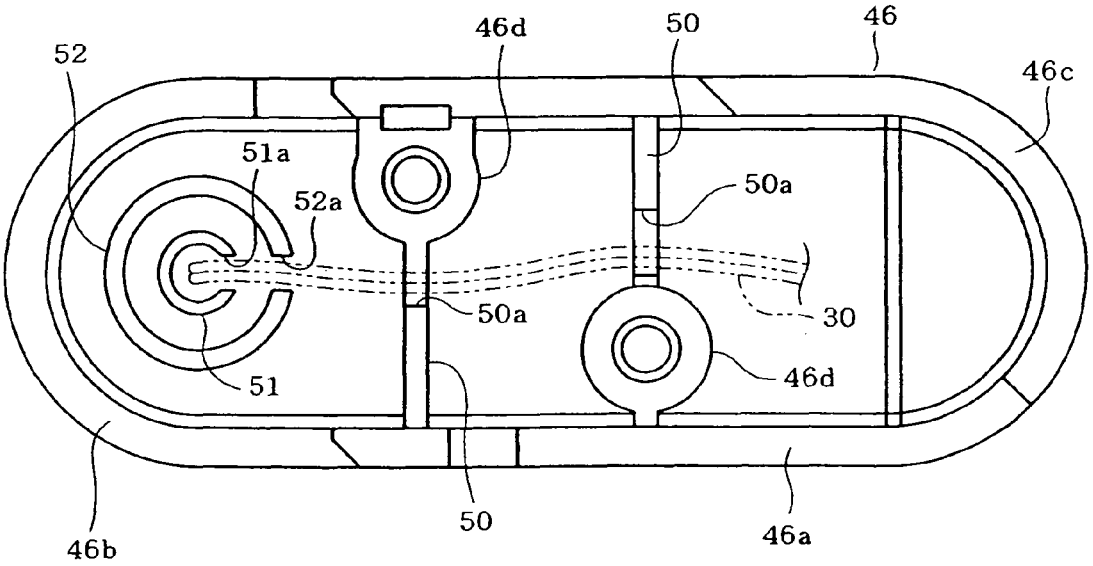

Two covers 45 and 46 are attached to the mounting portion 32 and the connecting arm 33 respectively. The mounting portion cover 45 is formed into the shape of a box-like container and covers the rear inclined surface 35*c* of the mounting portion 32 as shown in FIG. 11A. The mounting portion cover 45 has an outer peripheral wall 45*a* formed with an extending piece 45*b* covering the spring piece 38*b* of the second leaf spring 38 and includes a portion which faces the cam 40*d* of the connecting arm 33 and has a notch 45*c*. A detection switch 47 (a detection unit) is disposed inside the mounting portion cover 45 so as to be located near the notch 45*c*. A plate-like holder 48 holding the detection switch 47 is fixed by a screw 48*a*. The detection switch 47 has a detection lever 47*a* which can be brought into contact or sliding contact with the outer peripheral surface of the cam 40*d* of the connecting arm 33. The detection switch 47 is operated in the direction of arrow B1 or B2 in FIG. 11 with the detection lever 47*a* being separated from or brought into contact with an outer peripheral surface of the cam 40*d* in the swing of the lamp 20, whereby the detection switch 47 is turned on and off. FIG. 11A shows a part of the lead wire 49 along which an on-off signal of the detection switch 47 is delivered. The lead wire 49 is drawn from the mounting portion 32 side to the needle bar case 5 side, being connected to the control device 6 (see FIG. 12).

Furthermore, the mounting portion cover 45 has a mounting hole 45*d* formed therein. A screw (not shown) inserted through the hole 45*d* is threadingly engaged with the screw hole 35*e* formed in the rear inclined surface 35*c* of the mounting portion 32, whereby the mounting portion cover 45 is fixed to the mounting portion 32.

The arm cover 46 covering the connecting arm 33 is formed into the shape of an oval container and has a peripheral wall 46*a* having a notch 46*b* exposing the cam 40*d* of the connecting arm 40 and a notch 46*c* exposing the chamfered portion 41*b* of the connecting arm 33. Two reinforcement ribs 50 are formed inside the arm cover 46 and have respective fitting recesses 50*a* into each of which the flange 42*a* of the arm portion 42 is fitted. Furthermore, the arm cover 46 has an inner end from which two fitting convexities 51 and 52 concentrically protrude. The fitting convexity 51 is fitted into the through-hole 34*d* of the support shaft 34. The fitting convexity 52 abuts the annular plate 44*b* of the washer 44. The convexities 51 and 52 have respective notches 51*a* and 52*a* which continue to the fitting recesses 50*a*. The convexities 51 and 52 are each formed into a C-shape.

The lead wire 30 of the lamp 20 is passed through the fitting recesses 50*a* and the notches 51*a* and 52*a* (see two-dot chain line in FIG. 11B), thereby being accommodated in the arm cover 46 so as not to be exposed outward along the lengthwise direction with respect to the connecting arm 33. The lead wire 30 is shown by two-dot chain line without the aforesaid covers 45 and 46 being detached in FIG. 4. As shown in FIG. 4, the lead wire 30 is drawn from the through-hole 22 of the lamp 20 to the connecting arm 33 side to be connected via the side surface of the connecting arm 33, the hole 44*a* of the washer 44, the through-hole 34*d* of the support shaft 34 and the rear surface of the mounting portion 32 to a drive circuit 53 (see FIG. 12) of the multineedle sewing machine M. Two bosses 46*d* are formed inside the arm cover 46, and two screw holes 42*f* (see FIG. 10) are formed in the flanges 42*a* and 42*c* of the arm portion 42 respectively. A screw (not shown) inserted through the screw hole 42*f* of the arm portion 42 is threadingly engaged with the boss 46*d* of the arm cover 46.

Figure 2B:
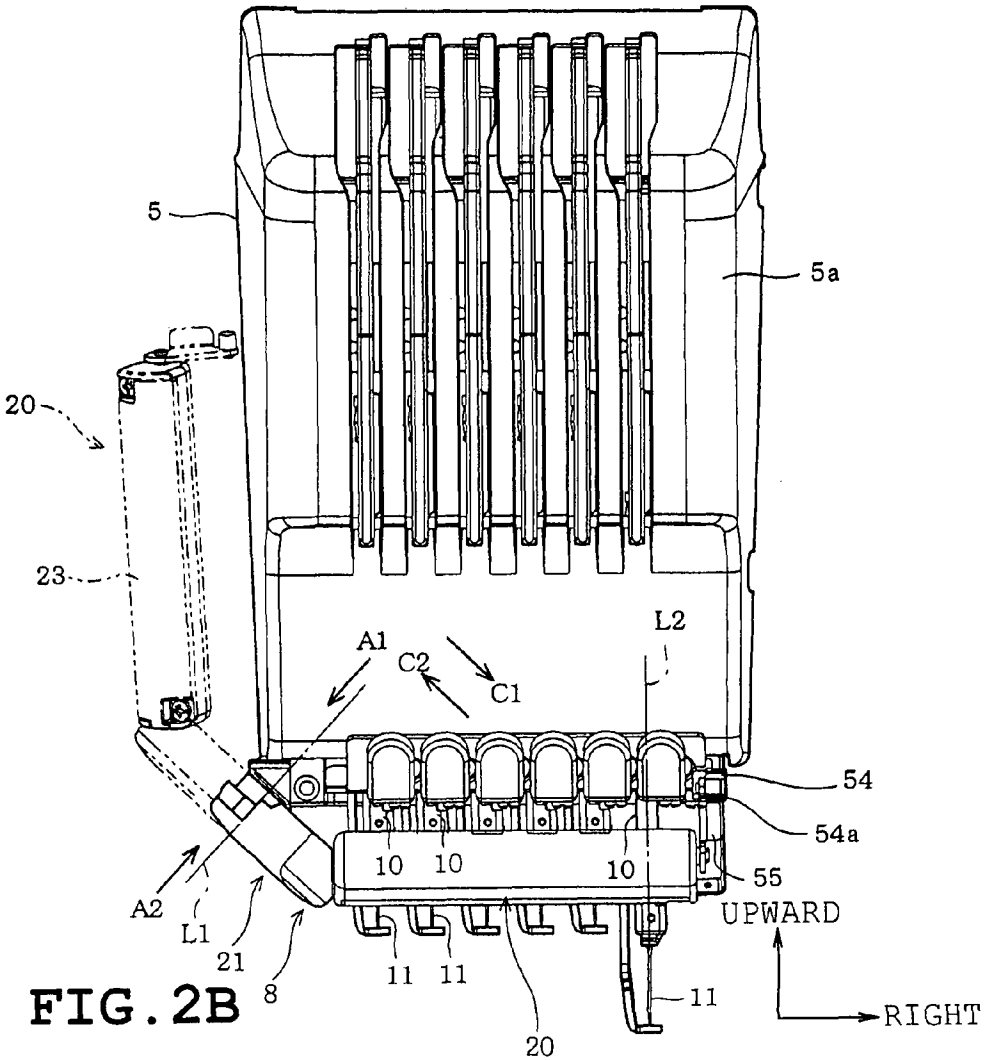
FIGS. 2A and 2B are a side view and a front view of the illumination device and a needle bar case.

A receiving member 54 maintaining the lamp 20 at the illuminating position is provided on a lower end on the right of the needle bar case 5 as shown in FIG. 2B. The receiving member 54 has a receiving portion 54*a* which has an open front and is formed into a general C-shape in a side view although the receiving portion 54*a* is not shown in detail. The receiving member 54 is fixed by a screw (not shown).

On the other hand, the rod member 24 is formed into the shape of an elongated bar and extends through the lamp 20 and the block portion 41 of the connecting arm 33 as shown in FIGS. 4, 8A and 8B. The rod member 24 has a distal end to which a holding member 55 detachably held by the receiving member 54 is fixed. The holding member 55 is formed into the shape of a plate extending along an end surface of the cover body 22 of the lamp 20 and has two ends formed with through-holes 55*a* and 55*b* respectively. More specifically, the holding member 55 is fixed to the distal end of the rod member 24 extending through the through-hole 55*a* so as to be perpendicular to the rod member 24. Furthermore, a fixing pin 55*c* which is to be detachably locked by the receiving portion 54*a* of the receiving member 54 is fixed through the through-hole 55*b* of the holding member 55. A lengthwise middle portion of the holding member 55 is bent thereby to be formed into a handgrip 55*d*. The user grips the handgrip 55*d* to attach or detach the fixing pin 55*c* of the holding member 55 to or from the receiving portion 54*a* of the receiving member 54 or to change the position of the lamp 20.

The support unit 21 serving as a swinging mechanism comprises the above-described mounting portion 32, the connecting arm 33, the support shaft 34, the rod member 24, the washer 44, the mounting portion cover 45, the arm cover 46 and the holding member 55. The lamp 20 is swung between the illuminating position and the storage position by the support unit 21 without contact with the multineedle sewing machine M side components such as the needle bar case 5 and an embroidery frame. The lamp 20 is maintained at the illuminating or the storage position. Subsequently, the arrangement of the control system of the embodiment will be described with reference to the block diagram of FIG. 12. The control device 6 serving as a control unit of the multineedle sewing machine M is mainly comprised of a microcomputer and includes a CPU 6*a*, a ROM 6*b* and a RAM 6*c*. The operation panel 7 and the detection switch 47 are connected to the control device 6. Furthermore, a drive circuit 56 for the sewing machine motor 16 and a drive circuit 53 for the lamp 20 and the like are also connected to the control device 6.

The control device 6 controls the chip LEDs 29 of the lamp 20 according to the result of detection by the detection switch 47 so that the chip LEDs 29 are turned on or off. For example, the control device 6 controls the chip LED 29*s* so that the chip LEDs 29 are turned on only when the detection switch 47 is turned on (see FIG. 13A) with movement of the lamp 20 to the illuminating position. The ROM 6*b* stores a sewing control program and the like, and the RAM 6*c* is provided with memories (buffers, counters and the like) necessary in execution of various controls. The control device 6 drives various actuators such as the sewing machine motor 16 according to the sewing program, thereby executing a sewing operation on workpiece cloth.

Figure 14A:
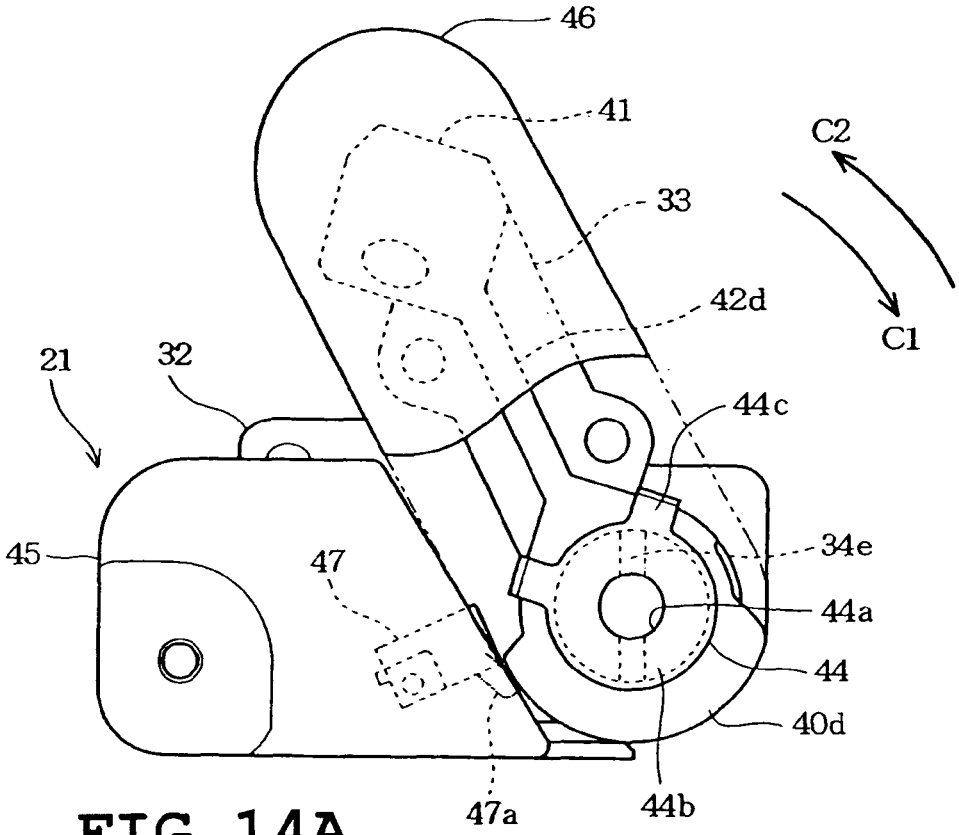
FIGS. 14A and 14*b* are views similar to FIGS. 13A and 13B, showing the support device with the illuminating apparatus having been switched to the storage position, respectively.
Figure 14B:
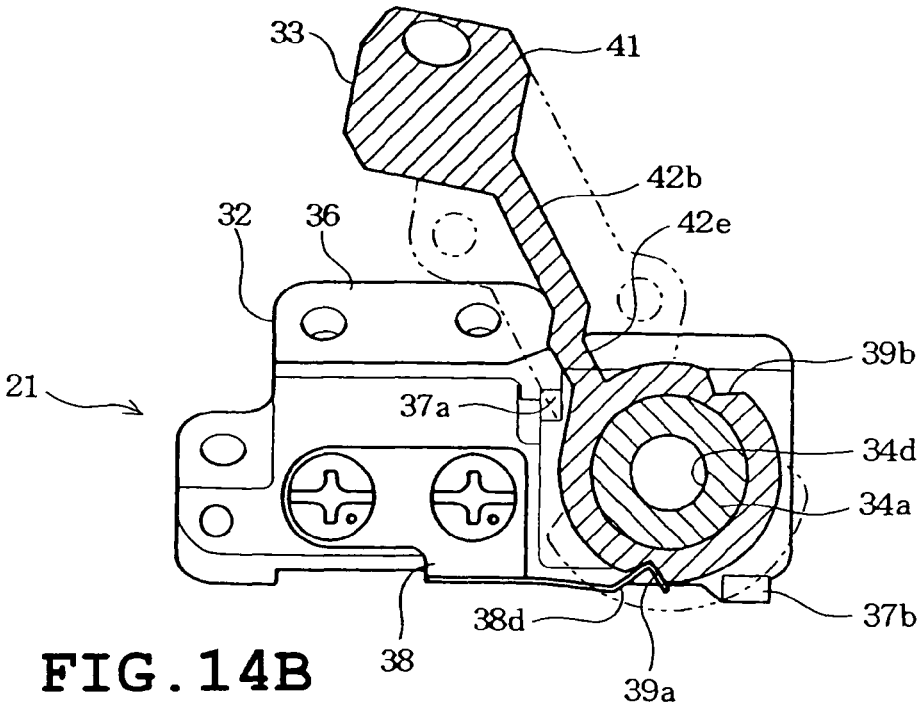

The operation of the illumination device 8 will now be described with reference to FIGS. 13A to 14B as well as FIGS. 1 to 12. The illumination device 20 occupying the accommodation position stands substantially upright along the side of the needle bar case 5, while opening the front sides of the needle bar 10 and the needle 11, as shown by two-dot chain line in FIGS. 2A and 2B. In this state, as shown in FIG. 14B, the abutment 38*d* of the second leaf spring 38 is in abutment with the detent recess 39*a* of the connecting arm 33 in the support device 21, and the engagement stepped portion 42*e* of the connecting arm 33 is locked by the lock piece 37*a*, whereupon the lamp 20 is maintained at the storage position. Furthermore, the detection lever 47*a* is in contact with the outer peripheral surface of the cam 40*d* such that the detection switch 47 is turned off (see FIG. 14A), whereby the chip LEDs 29 are turned off.

Figure 2A:
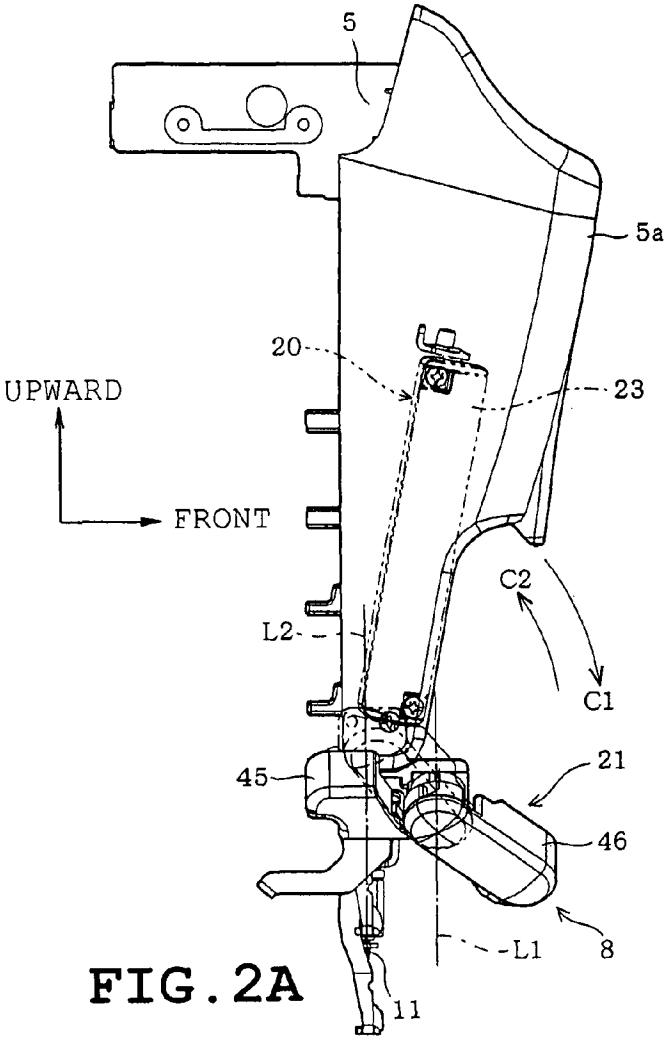

When the lamp 20 is to be switched to the illumination position, the user grips the handgrip 55*d* of the holding member 55, moving the lamp 20 in the direction of arrow C1 in FIG. 2A, for example. As a result, the lamp 20 is swung by the support device 21 around the support shaft 34 (namely, around the swing central axis line L1) to the illumination position as shown by solid line in FIG. 2. With this, the connecting arm 33 is swung about 180 degrees as viewed in a side view. In this case, as shown in FIG. 13, the abutment portion 38*d* of the second leaf spring 38 abuts the detent recess 39*b* of the connecting arm 33 in the support device 21, whereupon the user is given a click feel. The engagement stepped portion 42*e* of the connecting arm 33 is locked by the lock piece 37*b* of the mounting portion 32, whereby the illumination device 20 is maintained at the illuminating position. Furthermore, the detection lever 47*a* is separated from the outer periphery of the cam 40*d*. With this, the lamp 20 is moved in the direction of arrow B1 in FIG. 13A. As a result, since the detection switch 47 is turned on, the control device 6 turns on the chip LEDs 29.

The user then fits the fixing pin 55*c* of the holding member 55 into the receiving portion 54*a* of the receiving member 54 at the right lower end of the needle bar case 5. Consequently, the lamp 20 and the rod member 24 are rendered substantially parallel to each other along arranged six needle bars 10, whereupon the lamp 20 is reliably be maintained at the illumination position.

When located at the illuminating position, the lamp 20 is rotatively moved relative to the rod member 24 such that the illumination angle $\alpha$ in the front-back direction with respect to the periphery of the needle position can be adjusted to a desirable angle. In the adjustment, the lock pin 24*a* abuts the inner wall of the hole 25*e* thereby to be locked so that the rotative movement range of the lamp 20 is limited between a position (see FIG. 7A) where light from the chip LED 29 is irradiated substantially perpendicularly onto the periphery of the needle position and a position (see FIG. 7B) where light from the chip LED 29 is irradiated while the lamp 20 is inclined rearwardly downward. The illumination angle $\alpha$ set within the rotative movement range is maintained by elastically pressing the spring piece 27*b* of the leaf spring 27 against the outer periphery of the rod member 24. As a result, a sufficient amount of light can be irradiated onto the periphery of the needle position of the needle 11 at a desirable illumination angle, whereupon the threading to the needle 11 and confirmation of a print on the workpiece cloth can easily be carried out.

On the other hand, when a needle thread is hooked or the needle 11 is changed to another needle or when the lamp 20 is not used, the user grips the handgrip 55*d* of the holding member 55 and detaches the fixing pin 55*c* of the holding member 55 from the receiving portion 54*a* of the receiving member 54, so that the lamp 20 located at the illuminating position is swung in the direction of arrow C2 in FIG. 13A. With the operation of swinging the lamp 20, the detection lever 47*a* is brought into contact with the outer periphery of the cam 40*d*, for example, at the position of the connecting arm 33 having been swung about 20 degrees, thereby being operated in the direction of arrow B2 in FIG. 11A (see FIG. 13A). As a result, since the detection switch 47 is turned off, the control device 6 turns off the chip LEDs 29.

When the lamp 20 is moved from the illuminating position to the storage position as shown in FIG. 14B, the abutment portion 38*d* of the second leaf spring 38 abuts the detent recess 39*a* of the connecting arm 33 such that the user is given the clicking feel. With this, the engagement stepped portion 42*e* of the connecting arm 33 is locked by the lock piece 37*a* of the mounting portion 32, whereby the lamp 20 is maintained at the storage position. When the lamp 20 is located at the storage position, the front side of the needle bar 10 and the needle 11 is completely open as described above, and the front side of the needle bar case 5 (including the cover 5*a*) is opened. Consequently, the threading to the needle 11 and confirmation of a print on the workpiece cloth can be prevented from being blocked by the lamp 20 or the support device 21.

The illumination device 8 of the foregoing embodiment includes the lamp 20 and the support device 21 supporting the lamp 20 so that the lamp 20 is switchable between the illumination position where the lamp 20 is located in front of the needle bar 10 or the needle 11 and the periphery of the needle position of the needle 11 is illuminated by the chip LEDs 29 and the storage position where the lamp 20 opens the front side of the needle bar 10 or the needle 11 and is located laterally with respect to the needle bar case 5. According to this construction, the periphery of the needle position of the needle 11 can sufficiently be illuminated when the lamp 20 is located at the needle position or in front of the needle bar 10 or the needle 11. On the other hand, when the lamp 20 is located at the storage position or laterally with respect to the needle bar case 5, the needle thread can be hooked and the needle can be changed to another while the front side of the needle bar 10 or the needle 11 is open, whereupon the lamp 20 can be prevented from blocking the thread hooking and the needle change. Furthermore, the movement of the lamp 20 can easily be carried out only by switching the lamp 20 between the illuminating position and the storage position by the support device 21 without contact with the members (the needle bar case 5, the embroidery frame and the like) at the multineedle sewing machine M side. Thus, the usability of the multineedle sewing machine M can be improved.

The support device 21 has the support shaft 34 which supports the lamp 20 so that the lamp 20 is swingable between the illuminating position and the storage position about the swinging central axis line L1 which is parallel to the central axis line L2 of the needle bar 10 in a side view and inclined by the predetermined angle in a front view. Since the support device 21 has a supporting structure with the support shaft 34 serving as the fulcrum of the swinging, the lamp 20 can be switched between the illuminating position and the storage position by a simple construction.

For example, when the lamp 20 is switched from the illuminating position to the storage position, it is considered that the needle bar case 5 would be swung individually in the right-left direction and the front-back direction by using two hinges. On the other hand, the swinging central axis line L1 serving as the central axis of the support shaft 34 is set so as to be parallel to the central axis line L2 of the needle bar 10 in a side view and inclined by 45 degrees in a front view. Accordingly, the lamp 20 can be swung between the illuminating position and the storage position by a single support shaft 34, and the construction of the support shaft 34 can be simplified as much as possible.

The support device 21 includes the mounting portion 32 fixed to the side of the needle bar case 5, the connecting arm 33 connecting between the mounting portion 32 and the lamp 20, and the support shaft 34 supporting the lamp 20 via the connecting arm 33 so that the lamp 20 is swingable. When located at the illuminating position, the elongated lamp 20 is connected to the connecting arm 33 so that when located at the illuminating position, the lamp 20 is substantially horizontal along the arrangement of the plural needle bars 10 and when located at the storage position, the lamp 20 is substantially perpendicular to the arrangement of the needle bars 10 along the side of the needle bar case 5. Consequently, since the lamp 20 is substantially horizontal at the illuminating position, the chip LEDs 29 can illuminate along the arrangement of the needle bars 10. Furthermore, in the case where the elongated lamp 20 is caused to stand substantially perpendicular to the side of the needle bar case 5 when located at the storage position, the lamp 20 can be stored in the multineedle sewing machine M in a compact manner, whereupon the illumination device suitable for the multineedle sewing machine M can be provided.

The support device 21 includes the swinging mechanism supporting the lamp 20 so that the lamp 20 is swingable relative to the needle bar case 5. As a result, the lamp 20 can be switched between the illuminating position and the storage position by a simple construction. Furthermore, when the swinging central axis line L1 is set as described above, the construction of the support device can be simplified in the same manner as described above.

Furthermore, the illumination device 8 includes the detection switch 47 which detects the position of the lamp 20. The chip LEDs 29 are arranged so as to be turned on or off according to the result of detection by the detection switch 47. As a result, the chip LEDs 29 can be turned on when the lamp 20 is located at the illuminating position, and the chip LEDs 29 can be turned off when the lamp 20 is located at the storage position. More specifically, the user need not operate a separate turn-on operation switch in order that the light source may be turned on or off. Accordingly, the lamp 20 has an improved operability and is preferable on the view point of energy saving, whereupon the lamp 20 is advantageous in the practical use.

The lamp 20 is supported by the support device 21 so that the illumination angle $\alpha$ in the front-back direction with respect to the periphery of the needle position is suitably adjustable, whereupon the usability of the lamp 20 can further be improved.

The foregoing embodiment is not restrictive and may be modified or expanded as follows. The light source should not be limited to the chip LEDs 29. For example, the light source may be another LED and a fluorescent lamp. Furthermore, the inclination angle of the swinging central axis line L1 in the front view should be 45 degrees but may suitably be changed together with the angle of the swinging central axis line in the side view. The phrase, "substantially perpendicular" in the foregoing description involves the case of "perpendicular" and the phrase, "substantially horizontal" involves the case of "horizontal." More specifically, the lamp 20 may be supported so as to be horizontal at the illuminating position and perpendicular along the side of the needle bar case 5 at the storage position.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. An illumination device for a multineedle sewing machine which includes a plurality of needle bars having lower ends to which needles are attached respectively and a needle bar case supporting the needle bars so that the needle bars are movable upward and downward, the illumination device comprising:

an illuminating member having a light source; and a support unit provided in the needle bar case for supporting the illuminating member so that the illuminating member is switchable between an illuminating position where the illuminating member is located in front of the needle bars or the needles to illuminate a periphery of a needle position of the needle by the light source and a storage position where the illuminating member opens a front side of the needle bar or the needle and is located laterally with respect to the needle bar case.

2. The illumination device according to claim 1, wherein the support unit has a support shaft supporting the illuminating member so that the illuminating member is swingable between the illuminating position and the storage position about a central axis of swinging movement that is parallel to a central axis of the needle bar when viewed from a side and is inclined at a predetermined angle to the central axis of the needle bar when viewed from front.

3. The illumination device according to claim 2, wherein the support unit includes a mounting portion fixed to a side of the needle bar case and a connecting arm connecting between the mounting portion and the illuminating member, wherein the illuminating member is mounted on the connecting arm having the support shaft further mounted on the mounting portion, so as to be swingable, and the illuminating member is formed into an elongate shape and is connected to the connecting arm so as to be substantially horizontal along the needle bars when assuming the illuminating position and so as to be substantially perpendicular to the side surface of the needle bar case.

4. The illuminating device according to claim 1, wherein the support unit supports the illuminating member so that the illuminating member is swingable between the illuminating position and the storage position about the central axis of swinging movement that is parallel to a central axis of the needle bar when viewed from a side and is inclined at a predetermined angle to the central axis of the needle bar when viewed from front.

5. The illumination device according to claim 1, further comprising a position detecting unit which detects a position of the illuminating member, wherein the light source is turned on or off according to a result of detection by the position detecting unit.

6. The illumination device according to claim 1, wherein the illuminating member is supported so that an illumination angle in a front-back direction relative to the periphery of the needle location point is adjustable when assuming the illuminating position.

7. A sewing machine provided with an illumination device, which includes a plurality of needle bars having lower ends to which needles are attached respectively and a needle bar case supporting the needle bars so that the needle bars are movable upward and downward, the illumination device comprising:

an illuminating member having a light source; and a support unit provided in the needle bar case for supporting the illuminating member so that the illuminating member is switchable between an illuminating position where the illuminating member is located in front of the needle bars or the needles to illuminate a periphery of a needle point of the needle location point of the needle by the light source and a storage position where the illuminating member opens a front side of the needle bar or the needle and is located laterally with respect to the needle bar case.

* * * * *